United States Patent [19]

Satake

[11] 4,367,817

[45] Jan. 11, 1983

[54] COLOR DISCRIMINATING MACHINE

[75] Inventor: Toshihiko Satake, Higashihiroshima, Japan

[73] Assignee: Satake Engineering Co., Ltd., Tokyo, Japan

[21] Appl. No.: 234,749

[22] Filed: Feb. 17, 1981

[30] Foreign Application Priority Data

Feb. 22, 1980 [JP] Japan ..... 55-22065

[51] Int. Cl.[3] ..... B07C 5/342

[52] U.S. Cl. ..... 209/580; 209/639; 209/920

[58] Field of Search ..... 209/576, 577, 578, 580, 209/581, 587, 588, 639, 908, 911, 920, 922

[56] References Cited

U.S. PATENT DOCUMENTS

| | | | |
|---|---|---|---|
| 3,216,567 | 11/1965 | Kelly et al. | 209/639 X |
| 3,283,896 | 11/1966 | Jirik et al. | 209/587 X |
| 3,482,686 | 12/1969 | Wood | 209/587 |
| 3,738,484 | 6/1973 | Hoover et al. | 209/581 |
| 3,990,580 | 11/1976 | Self | 209/580 X |
| 4,196,811 | 4/1980 | Pilesi et al. | 209/588 |
| 4,252,240 | 2/1981 | Satake | 209/580 |

FOREIGN PATENT DOCUMENTS

| | | | |
|---|---|---|---|
| 1036461 | 9/1953 | France | 209/581 |
| 703694 | 2/1954 | United Kingdom | 209/587 |

*Primary Examiner*—Robert B. Reeves
*Assistant Examiner*—Edward M. Wacyra
*Attorney, Agent, or Firm*—Norbert P. Holler

[57] ABSTRACT

A downward-flow trough angle adjusting device for a color discriminating machine having a downward-flow trough mounting device for detachably mounting the trough, the device being secured to the upper surface of a frame defining a photoelectric discriminating chamber to provide a unitary structure. The photoelectric discriminating chamber frame is connected at one side to a machine frame for pivotal movement while being movably supported at the other side by the machine frame through a threaded shaft-nut assembly. Thus, as the photoelectric chamber frame is vertically moved at the other end by actuating the threaded shaft-nut assembly to adjust the angle of inclination of the downward-flow trough, the photoelectric discriminating chamber frame also moves together with the downward-flow trough, thereby enabling the downward-flow trough to be correctly positioned at all times with respect to a collecting tube in the photoelectric discriminating chamber for receiving the granular material of interest from which granular materials of colors distinct from that of the granular material of interest have been separated by electrophotographic color discrimination.

3 Claims, 2 Drawing Figures

COLOR DISCRIMINATING MACHINE

This invention relates to color discriminating machines in general, and more particularly it is concerned with a device for adjusting the angle of the downward-flow trough suitable for use with a color discriminating machine.

A color discriminating machine is known in which granular materials having those of different colors incorporated therein are supplied to a downward-flow trough and a light beam is directed against a flux of granular materials flowing straight from the downward-flow trough into a photoelectric discriminating chamber located below the downward-flow trough to detect the reflected or transmitted light beam by means of a photoelectric sensor to thereby detect granular materials of colors distinct from that of the granular material of interest forming the major portion of the flux of granular materials. The output of the photoelectric sensor is inputted to a control circuit to electrically actuate injection nozzles mounted beneath the photoelectric sensor so as to separate the granular material of different colors from the flux of granular materials by the action of the jets of air.

This type of color discriminating machine has particular utility in selecting cereal grains of different colors from the cereal grain of interest forming the major portion of the flux, although its use is not limited thereto. When this type of color discriminating machine is used for detecting cereal grains of different colors, the cereal grain of interest from which cereal grains of different colors are to be separated has specific physical properties, such as specific gravity, coefficient of friction, etc., depending on the type, place of origin, moisture content and other factors, so that it becomes necessary to replace the downward-flow trough by a new one suitable for the particular cereal grain or adjust the angle of inclination of the downward-flow trough to control the flow velocity of the cereal grains flowing downwardly in a flux through the downward-flow trough. It has been ascertained that the efficiency with which separation of cereal grains of different colors from the cereal grain of interest forming the major portion of the flux is effected may vary depending on the condition of the flux of cereal grains containing those of different colors and the flow velocity thereof in the photoelectric discriminating chamber.

Heretofore, this type of color discriminating machine has been constructed such that the photoelectric discriminating chamber is secured to the bottom of the machine frame of the color discriminating machine, and the downward-flow trough is directly suspended from the beam or partition plate in the middle portion of the machine frame to be connected to the photoelectric discriminating chamber. Alternatively, the downward-flow trough is indirectly suspended from the beam or partition plate through a downward-flow trough pivotal mounting device to be connected to the photoelectric discriminating chamber. Some disadvantages are associated with this type of color discriminating machine of the prior art. When the angle at which the downward-flow trough is mounted is changed or adjusted, a slight variation might be caused to occur in the path of the flux of granular materials in the photoelectric discriminating chamber. Difficulties are experienced in bringing the downward-flow trough into alignment with the axis of the photoelectric discriminating chamber, and the operation of replacing the old downward-flow trough by a new one is time consuming and requires a lot of labor.

This invention has been developed for the purpose of obviating the aforesaid disadvantages of the prior art. Accordingly, the invention has as its object the provision of a novel downward-flow trough angle adjusting device suitable for use with a color discriminating machine which enables the angle of the downward-flow trough to be adjusted without causing any change in the efficiency with which detection of granular materials of colors different from that of the granular material of interest forming the major portion of the flux of granular materials and separation of the granular materials of different colors from the granular material of interest is carried out.

According to the invention, there is provided the combination comprising: a color discriminating machine comprising means for supplying granular materials having incorporated therein granular materials of colors different from that of the granular material of interest, means for feeding granular materials supplied to the machine, an inclined downward-flow trough located on the outlet end of said granular material feeding means, and a photoelectric discriminating chamber connected to the lower end of said downward-flow trough, said photoelectric discriminating chamber having mounted therein a photoelectric sensing device directing a light beam against a flux of granular materials flowing straight from the downward-flow trough into the photoelectic discriminating chamber and detecting a light beam reflected or transmitted by the granular materials of different colors, and air injection nozzle means electrically connected through a control circuit to said photoelectric sensing device so as to be actuated by an output of said photoelectric sensing device for separating the granular materials of different colors from the flux of granular materials; and a downward-flow trough angle adjusting device comprising downward-flow trough mounting means secured to the photeolectric discriminating chamber for detachably mounting said downward-flow trough, and angle adjusting means connected to said photoelectric discriminating chamber for adjusting the angle of inclination of said downward-flow trough.

The outstanding features of the invention are that, in place of suspending the downward-flow trough from the middle portion of the machine frame, downward-flow trough mounting means for detachably mounting the downward-flow trough is secured to the upper portion of the photoelectric discriminating chamber, and downward-flow trough angle adjusting means is connected to said photoelectric discriminating chamber for adjusting the angle of inclination of the downward-flow trough mounted on the photoelectric discriminating chamber to provide a unitary structure. By virtue of these features, it is possible to arrange the downward-flow trough and the collecting tube within the photoelectric discriminating chamber in a straight line without any trouble each time the angle of inclination of the downward-flow trough is adjusted so that the line connecting the center line of a flux of granular materials of different colors to the collecting tube within the discriminating chamber can be made to coincide with the path of the flux of granular materials between the lower end of the downward-flow trough and the upper end of the collecting tube. Thus it is possible to let a stream of granular materials of different colors flow positively in a predetermined direction through a predetermined position within the photoelectric discriminating chamber, and at the same time it is possible to readily effect adjustments of the angle of inclination of the downward-flow trough. This makes it possible to readily and positively regulate the flow velocity of the stream of granular materials of different colors flowing through the predetermined path, thereby enabling replacements of the downward-flow trough to be readily effected in accordance with the physical properties of the granular material of interest from which granular materials of different colors are to be separated.

Thus the invention enables selection of granular materials by color to be effected with a high degree of accuracy and permits the performance of the machine to perform discrimination to be greatly increased.

The foregoing and still other advantages of the present invention will be made more apparent from the following detailed explanation of the preferred embodiment of the invention in connection with the accompanying drawings wherein.

Figure 1:
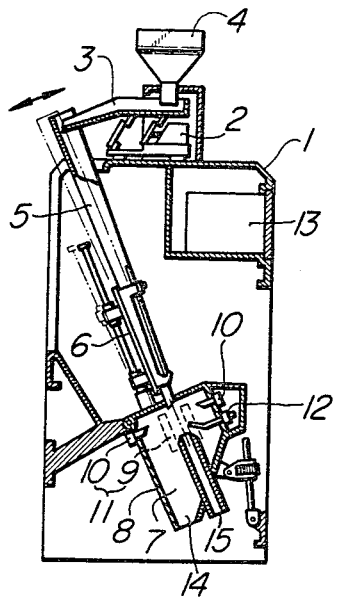
FIG. 1 is a sectional side view of the embodiment of the invention.
Figure 2:
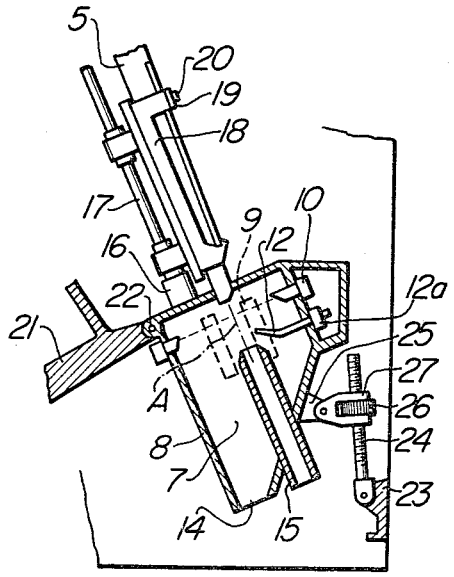
FIG. 2 is a sectional view, on an enlarged scale, of the photoelectric discriminating chamber.

In FIGS. 1 and 2, the color discriminating machine comprises a machine frame 1 having supported on the upper portion thereof a vibratory granular material feeding trough 3 provided with a vibrator 2. A hopper 4 is mounted on the upper portion of the vibratory granular material feeding trough 3 for supplying granular materials including those of colors differing from that of the granular material of intest to the machine. Arranged on the outlet side of the vibratory granular material feeding trough 3 in an inclined position is a downward-flow trough 5 in the form of a letter V in cross section which is detachably mounted on downward-flow trough mounting means 6 secured to a frame 8 of a photoelectric discriminating chamber 7 located in the lower portion of the machine frame 1. A photoelectric sensor 11 including light sources 9 and light receiving elements 10 and air injection nozzle means 12 located below the photoelectric sensor 11 and having an electromagnetic valve 12*a* connected to an air compressor, not shown, disposed outside the photoelectric discriminating chamber 7 are mounted on the inner wall surface of the frame 8 in a manner to surround path A of a stream of granular materials flowing straight from the lower end of the downward-flow trough 5. The photoelectric sensor 11 is electrically connected to the injection nozzle means 12 through a control circuit 13. An outlet port 14 for granular materials of different colors is formed at the bottom of the photoelectric discriminating chamber 7, and a collecting tube 15 for collecting the granular material of interest for removal from the color discriminating chamber 7 is arranged on an extension of the path A of the flux of granular materials.

The downward-flow trough mounting means 6 comprises a base 16 secured to the upper wall surface of the frame 8, two rods 17 connected at lower ends to the base 16 in an upright position, and a downward-flow trough mounting metal member 18 fitted over the two rods 17 for vertical sliding movement. The mounting metal member 18 is formed with a groove of the form of a letter V which receives therein the downward-flow trough 5 which is force fitted in the V-shaped groove of the mounting member 18 as a cover plate 19 is secured to the mounting metal member 18 by means of screws 20, to thereby detachably secure the downward-flow trough 5 to the mounting metal member 18.

The frame 8 of the photoelectric discriminating chamber 7 is pivotally supported at its upper left end portion as viewed in the figures on a pivot shaft 22 supported at the forward ends of support bars 21 (only one is shown) projecting from the lower portion of one side of the machine frame 1. An adjusting threaded shaft 24 pivotally supported on a cross bar 23 secured to the machine frame 1 and arranged opposite to the support bars 21 is connected to an adjusting metal member 25 supported on the right side of the frame 8 as viewed in the figures through a nut holder 27 pivotally connected to the adjusting metal member 25 for supporting for rotation a nut 26 which threadably engages the adjusting threaded shaft 24. By this arrangement, rotation of the nut 26 causes the frame 8 to pivotally move vertically about the pivot shaft 22, so that the downward-flow trough 5 mounted on the frame 8 to provide a unitary structure can have its angle of inclination adjusted as indicated by arrows and dash-and-dot lines in FIG. 1. The members described hereinabove constitute angle adjusting means for the downward-flow trough 5.

The embodiment is of the aforesaid construction. In operation, granular materials having those of colors different from that of the granular material of interest incorporated therein are supplied through the hopper 4 to the vibratory granular material feeding trough 3 which vibrates as the vibrator 2 is rendered operative, to allow the granular materials to flow into the downward-flow trough 5. A flux of granular material flowing downwardly through the downward-flow trough 5 is discharged from the lower end of the trough 5 and flows in a stream through the predetermined path A in the photoelectric discriminating chamber 7, in which light beams directed from the light sources 9 against the flux of granular materials are reflected or transmitted by the granular materials of colors distinct from that of the granular material of interest. The reflected or transmitted light beams are received by the light receiving elements 10 which generate signals supplied to the control circuit 13 to actuate the electromagnetic valve 12*a* of the air injection nozzle means 12 to eject jets of air at an opportune time, to separate the granular materials of different colors from the flux of granular materials flowing through the predetermined path A. The separated granular materials of different colors are removed from the chamber 7 through the outlet port 14 while the granular material of interest flowing through the predetermined path A is withdrawn from the machine frame 1 through the collecting tube 15, to be transferred to the next operation station.

As described hereinabove, the downward-flow trough 5 is connected to the photoelectric discriminating chamber 7 to provide a unitary structure, and the downward-flow trough 5 can be readily mounted on the downward-flow trough mounting means merely by fitting the trough 5 in the V-shpaed groove of the mounting metal member 18 and securing the cover plate 19 by the screws 20. The trough 5 can be readily detached from the downward-flow trough mounting means by reversing the aforesaid steps. This greatly simplifies the operation of replacing the old downward-flow trough 5 by a new one depending on the physical properties of the granular material of interest from which granular materials of different colors are to be removed. The invention enables the flux of granular materials to positively flow through a predetermined path which is disposed in a predetermined position and oriented in a predetermined direction. At the same time, the angle of inclination of the downward-flow trough 5 can be adjusted to a desired value merely by rotating the nut 26 on the adjusting threaded shaft 24 connecting the machine frame 1 to the frame 8 of the photoelectric discriminating chamber 7 to thereby vertically move one side of the frame 8, so that the flow velocity of the flux of granular materials flowing through the predetermined path A can be positively regulated. The invention eliminates the risk of off-centering of the path of the flux of granular materials in the photoelectric discriminating chamber which has hitherto been experienced in adjusting the angle of inclination of the downward-flow trough in a color discriminating machine of the prior art. Thus the color discriminating machine incorporating therein the present invention has its color discriminating performance greatly improved, so that separation of the granular materials of colors distinct from that of the granular material of interest can be carried out with a high degree of accuracy to enable the granular material of interest to be obtained in large quantities in a short period of time.

What is claimed is:

1. The cobmination comprising:

a color discriminating machine comprising means for supplying granular materials having incorporated therein granular materials of colors different from that of the granular material of interest, means for feeding granular materials supplied to the machine, an inclined downward-flow trough located on the outlet end of said granular material feeding means, and a photoelectric discriminating chamber connected to the lower end of said downward-flow trough, said photoelectric discriminating chamber having mounted therein a photoelectric sensing device directing a light beam against a flux of granular materials flowing straight from the downward-flow trough into the photoelectric discriminating chamber and detecting a light beam reflected or transmitted by the granular materials of different colors, and air injection nozzle means electrically connected through a control circuit to said photoelectric sensing device so as to be actuated by an output of said photoelectric sensing device for separating the granular materials of different colors from the flux of granular materials; and a downward-flow trough angle adjusting device comprising downward-flow trough mounting means secured to the photoelectric discriminating chamber for detachably mounting said downward-flow trough, and angle adjusting means connected to said photo electric discriminating chamber for adjusting the angle of inclination of said downward-flow trough.

2. The combination as claimed in claim 1, wherein said angle adjsuting means of said downward-flow trough angle adjusting device comprises means for pivotally supporting one side of said photoelectric discriminating chamber, and means including a threaded shaft-nut assembly for vertically moving the other side of said photoelectric discriminating chamber.

3. The combination as claimed in claim 1, wherein said downward-flow trough mounting means of said downward-flow trough angle adjusting device comprises a groove for receiving downward-flow trough therein, and a cover plate for securing the downward-flow trough received in said groove.

* * * * *